United States Patent [19]

Kobayashi et al.

[11] Patent Number: 4,651,700

[45] Date of Patent: Mar. 24, 1987

[54] METHOD AND APPARATUS FOR CONTROLLING AIR-FUEL RATION IN INTERNAL COMBUSTION ENGINE

[75] Inventors: Nobuyuki Kobayashi; Toshimitsu Ito, both of Toyota; Takao Akatsuka, Aichi; Masakazu Ninomiya, Kariya, all of Japan

[73] Assignees: Toyota Jidosha Kabushiki Kaisha, Toyota; Nippondenso Co., Ltd., Kariya, both of Japan

[21] Appl. No.: 749,088

[22] Filed: Jun. 26, 1985

[30] Foreign Application Priority Data

Jun. 29, 1984 [JP] Japan ..... 59-132996

[51] Int. Cl.[4] ..... F02M 51/00

[52] U.S. Cl. ..... 123/489; 123/440

[58] Field of Search ..... 123/438, 440, 478, 480, 123/486, 489

[56] References Cited

U.S. PATENT DOCUMENTS

| | | | |
|---|---|---|---|
| 4,109,615 | 8/1978 | Asano | 123/440 |
| 4,411,232 | 10/1983 | Atago et al. | 123/438 |
| 4,416,239 | 11/1983 | Takase et al. | 123/489 X |
| 4,481,929 | 11/1984 | Hasegawa | 123/489 X |
| 4,494,512 | 1/1985 | Kishi et al. | 123/489 |
| 4,495,921 | 1/1985 | Sawamoto | 123/438 |
| 4,509,485 | 4/1985 | Hasegawa | 123/489 X |
| 4,526,153 | 7/1985 | Hasegawa et al. | 123/489 X |
| 4,528,961 | 7/1985 | Katoh et al. | 123/489 |

FOREIGN PATENT DOCUMENTS

| | | |
|---|---|---|
| 2534708 | 4/1984 | France . |
| 2089073 | 6/1982 | United Kingdom . |
| 2142170 | 1/1985 | United Kingdom . |

*Primary Examiner*—Willis R. Wolfe, Jr.

*Attorney, Agent, or Firm*—Cushman, Darby & Cushman

[57] ABSTRACT

In an internal combustion engine wherein feedback control of the air-fuel ratio is carried out in accordance with the concentration of a specific composition in the exhaust gas, so that the air-fuel ratio is close to an aimed air-fuel ratio, the atmospheric pressure is detected, and the aimed air-fuel ratio is varied in accordance with the detected atmospheric pressure.

21 Claims, 11 Drawing Figures

| Fig. 3 A |
| --- |
| Fig. 3 B |

METHOD AND APPARATUS FOR CONTROLLING AIR-FUEL RATION IN INTERNAL COMBUSTION ENGINE

BACKGROUND OF THE INVENTION (1) Field of the Invention

The present invention relates to a method and apparatus for feedback control of the air-fuel ratio in an internal combustion engine.

(2) Description of the Related Art

As measures taken against exhaust gas pollution and fuel consumption, a lean burn system has recently been developed. According to this lean burn system, a lean mixture sensor is provided for generating an analog current in proportion to the air-fuel mixture on the lean side in an exhaust pipe of an engine. Thus, the feedback of the air-fuel ratio of the engine can be controlled by using the analog output of the lean mixture sensor, thereby attaining any air-fuel ratio on the lean side.

That is, the above-mentioned air-fuel feedback control makes use of the characteristic strong relationship between the output current of a lean mixtue sensor to the concentration of the oxygen in the exhaust gas in the case of a lean air-fuel ratio, as compared with the stoichiometric air-fuel ratio.

However, the output current of the lean mixture sensor varies in accordance with the atmospheric pressure around the lean mixture sensor. For instance, at a high altitude, the atmospheric pressure is reduced. Accordingly, the output current of the lean mixture sensor is reduced, since this output current is approximately proportional to the oxygen concentration. As a result, the air-fuel ratio is sensed as on the richer side, whereby the air-fuel ratio feedback control controls the air-fuel ratio to be leaner. The actual air-fuel ratio thus becomes leaner with respect to the aimed lean air-fuel ratio, possibly causing misfiring or surging of the engine.

SUMMARY OF THE INVENTION

It is an object of the present invention to provide a method and apparatus for controlling the air-fuel ratio in an internal combustion engine which can avoid misfiring or surging even at high attitudes.

According to the present invention, in an internal combustion engine wherein feedback control of the air-fuel ratio is carried out in accordance with the concentration of a specific composition in the exhaust gas, so that the air-fuel ratio is close to an aimed air-fuel ratio, the atmospheric pressure is detected, and the aimed air-fuel ratio is varied in accordance with the detected atmospheric pressure. That is, when the detected atmospheric pressure becomes low at a high altitude, the aimed air-fuel ratio is decreased. As a result, the controlled air-fuel ratio at a high altitude is kept from shifting to the leaner side, thus avoiding misfiring or surging.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENTS

Figure 1:
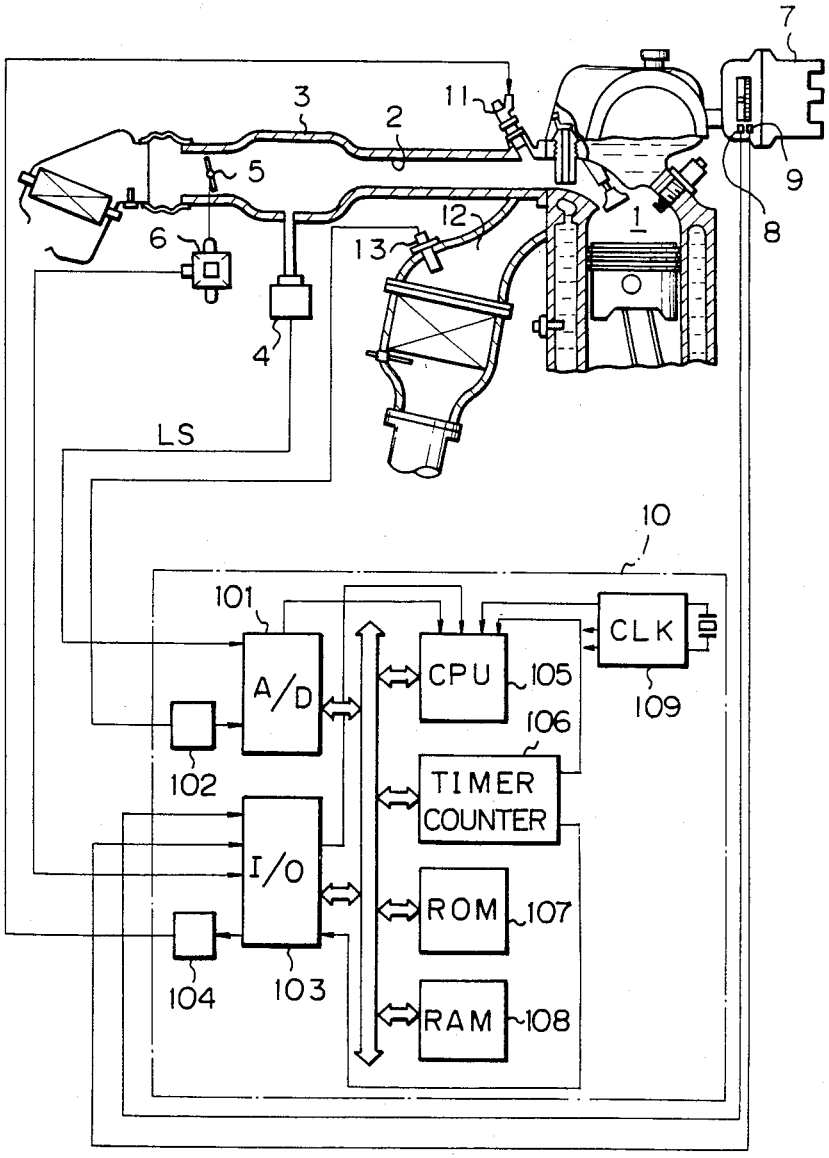
FIG. 1 is a schematic diagram of an internal combustion engine according to the present invention.

In FIG. 1, which illustrates an internal combustion engine according to the present invention, reference numeral 1 designates a four-cycle spark ignition engine disposed in an automotive vehicle. Provided in an air-intake passage 2 of the engine 1 is a surge tank 3 in which a pressure sensor 4 is provided. The pressure sensor 4 is used for detecting the absolute pressure within the air-intake passage 2 and transmits its output signal to a multiplexer-incorporating analog-to-digital (A/D) converter 101 of a control circuit 10.

Provided in a throttle valve 5 of the air-intake passage 2 is a throttle switch 6, which is turned on when the opening of the throttle valve 5 is larger than a predetermined angle such as 25°. Note that, when the opening of the throttle valve 5 reaches the predetermined value, the pressure within the surge tank 3 is approximately the same as the atmospheric pressure. The output LS of the throttle switch 5 is supplied to an input/output (I/O) interface 103 of the control circuit 10.

Disposed in a distributor 7 are crank angle sensors 8 and 9 for detecting the angle of the crankshaft (not shown) of the engine 1. In this case, the crank angle sensor 8 generates a pulse signal at every 720° crank angle (CA) while the crank angle sensor 9 generates a pulse signal at every 30°CA. The pulse signals of the crank angle sensors 8 and 9 are supplied to the I/O interface 103 of the control circuit 10. In addition, the pulse signal of the crank angle sensor 9 is then supplied to an interruption terminal of a central processing unit (CPU) 105.

Additionally provided in the air-intake passage 2 is a fuel injector 11 for supplying pressurized fuel from the fuel system (not shown) to the air-intake port of the cylinder of the engine 1. In this case, other fuel injectors are also provided for other cylinders, though not shown in FIG. 1.

Figure 2:
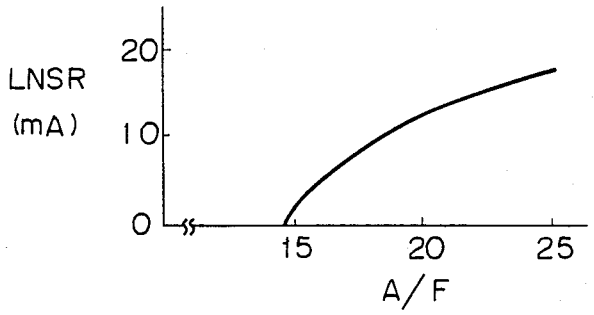
FIG. 2 is a graph showing the output characteristics of the lean mixture sensor of FIG. 1.

Provided in an exhaust gas passage 12 of the engine 1 is a lean mixture sensor 13 for detecting the concentration of oxygen composition in the exhaust gas. The lean mixture sensor 13 generates a limit current signal LNSR as shown in FIG. 2 and transmits it a via a current-to-voltage converter circuit 102 of the control circuit 10 to the A/D converter 101 thereof.

The control circuit 10, which may be constructed by a microcomputer, includes a driver circuit 104 for driving the fuel injector 11, a timer counter 106, a read-only memory (ROM) 107 for storing a main routine, interrupt routines such as a fuel injection routine, an ignition timing routine, tables (maps), constants, etc., a random access memory 108 (RAM) for storing temporary data, a clock generator 109 for generating various clock signals, and the like, in addition to the A/D converter 101, the current-to-voltage converter circuit 102, the I/O interface 103, and the CPU 105.

The timer counter 106 may include a free-running counter, a compare register, a comparator for comparing the content of the free-run counter with that of the compare register, flag registers for compare interruption, injection control, and the like. Of course, the timer counter 106 also may include a plurality of compare registers and a plurality of comparators. In this case, the timer counter 106 is used for controlling the injection start and end operation.

Interruptions occur at the CPU 105, when the A/D converter 101 completes an A/D conversion and generates an interrupt signal; when the crank angle sensor 9 generates a pulse signal; when the timer counter 106 generates a compare interrupt signal; and when the clock generator 109 generates a special clock signal.

The pressure data PM of the pressure sensor 4 and the limit current data LNSR of the lean mixture sensor 13 are fetched by an A/D conversion routine executed at every predetermined time period and are then stored in the RAM 108. That is, the data PM and LNSR in the RAM 108 are renewed at every predetermined time period. The engine rotational speed $N_e$ is calculated by an interrupt routine executed at 30°CA, i.e., at every pulse signal of the crank angle sensor 9, and is then stored in the RAM 108.

In FIG. 2, which shows the output characteristics of the lean mixture sensor 13 of FIG. 1, it is assumed that a definite voltage is applied to the lean mixture sensor 13. As shown in FIG. 2, as the oxygen concentration in the exhaust gas increases, that is, as the air-fuel ratio A/F increases, the limit current LNSR also increases.

The operation of the control circuit 10 of FIG. 1 will be explained with reference to FIGS. 3 through 8.

Figures 3, 3A:
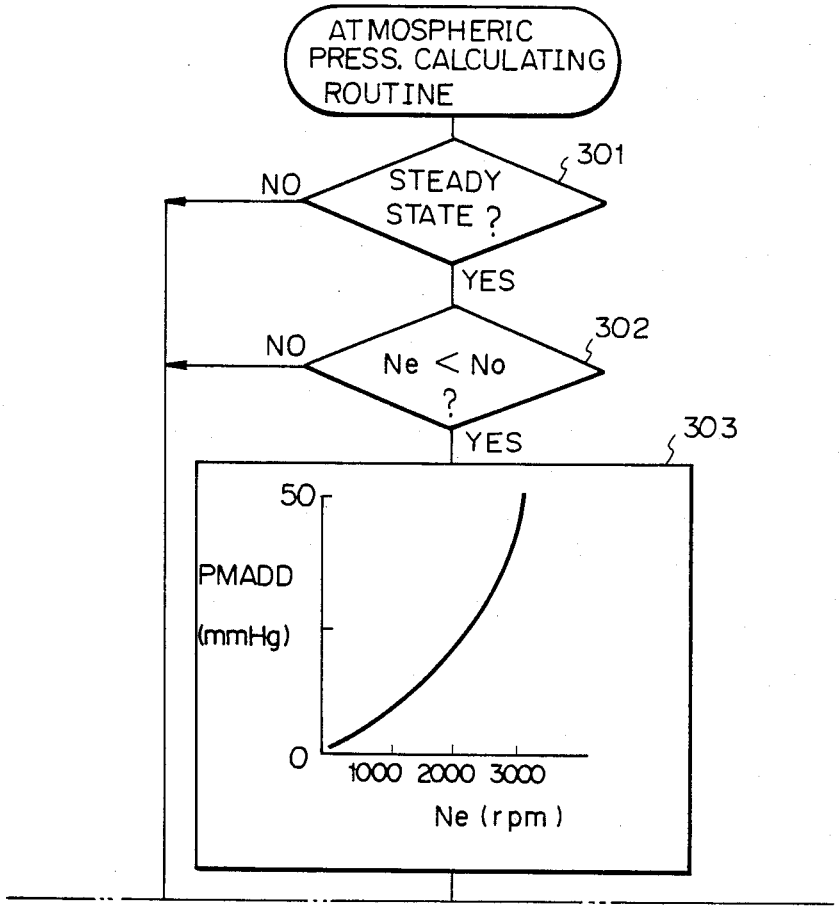
FIGS. 3 through 8 are flow charts showing the operation of the control circuit of FIG. 1.
Figure 3B:
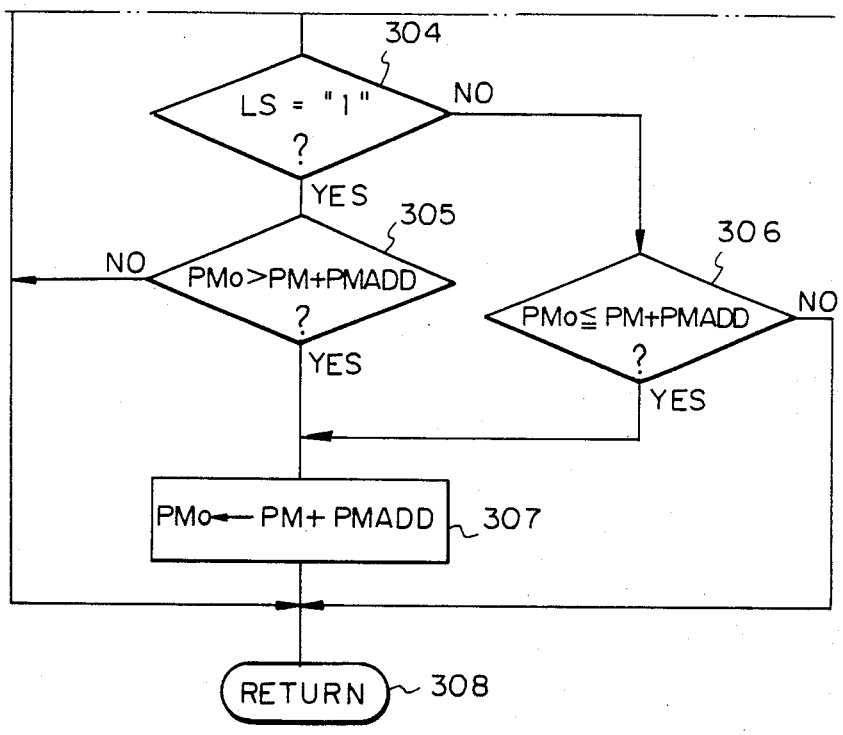

FIG. 3 is a routine for calculating the atmospheric pressure $PM_0$ executed at every predetermined time period. In this routine, the atmospheric pressure $PM_0$ is calculated by using the intake air pressure PM. That is, at step 301, it is determined whether or not the engine is in a steady state. The determination of such a steady state is carried out by determining:

(i) whether or not the variation ΔPM of the intake air pressure is within a predetermined range or (ii) whether or not the value $|PM-PMAV|$ (where PMAV is a blunt mean value of PM) is smaller than a predetermined value.

At step 302, the engine speed date $N_e$ is read out of the RAM 108, and it is determined whether or not $N_e<N_0$ is satisfied. In this case, the value $N_0$ is, for example, 3000 rpm.

Only when both of the determinations at steps 301 and 302 are affirmative, does the control proceed to step 303. Otherwise, the control jumps to step 308.

At step 303, an intake air pressure correction amount PMADD is calculated from a one-dimensional map stored in the ROM 107 by using the parameter $N_e$. Note that this one-dimensional map is shown in the block of step 303.

At step 304, it is determined whether or not the ouput LS of the throttle switch 6 is "1", i.e., the opening of the throttle valve 6 is larger than 25°.

If LS="1", then the control proceeds to step 305, which determines whether or not $PM_0>PM+PMADD$ is satisfied. If satisfied, the control proceeds to step 307, which replaces the atmospheric pressure data $PM_0$ with the value PM+PMADD. That is, as the vehicle moves from a low altitude to a high altitude, the atmospheric pressure data $PM_0$ is reduced. If $PM_0 \leqq PM+PMADD$ at step 305, the control jumps to step 308.

On the other hand, if LS="0", then the control proceeds to step 306, which determines whether or not $PM_0 \leqq PM+PMADD$ is satisfied. If satisfied, the control proceeds to step 307 which replaces the atmospheric pressure data $PM_0$ with the value PM+PMADD. That is, as the vehicle moves from a high altitude to a low altitude, the atmospheric pressure data $PM_0$ is increased. If $PM_0 \geqq PM+PMADD$ at step 306, the control jumps to step 308.

Thus, the atmospheric pressure $PM_0$ is obtained by using the intake air pressure PM. However, note that the atmospheric pressure $PM_0$ is obtained by using the data $Q/N_e$, where Q is the intake air amount, instead of the intake air pressure PM.

Figure 4:
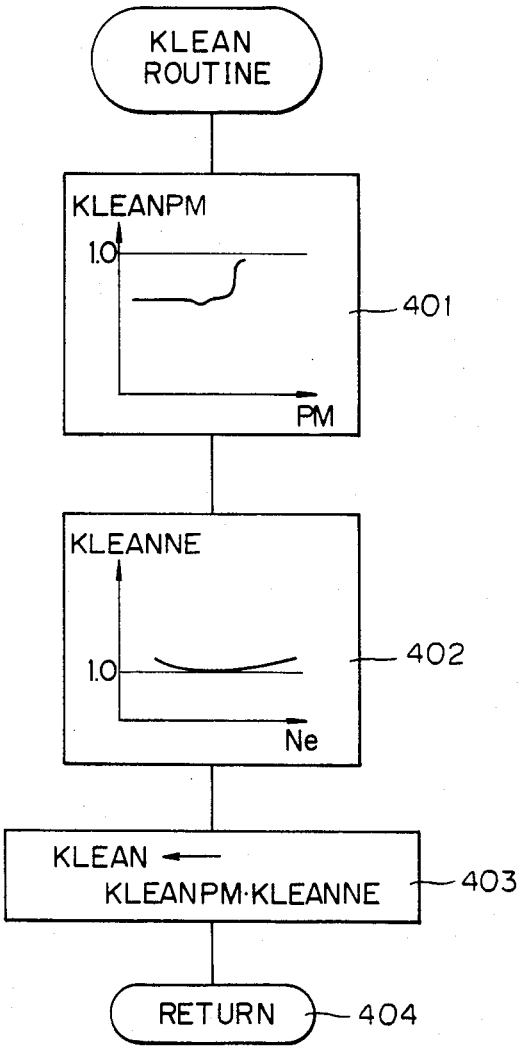

FIG. 4 is a routine for calculating a lean air-fuel ratio correction coefficient KLEAN executed at every predetermined time period. Note that the coefficient KLEAN satisfies the condition: $KLEAN \leqq 1.0$.

At step 401, KLEANPM is calculated from a one-dimensional map stored in the ROM 107 by using the parameter PM as shown in the block of step 401. Also, at step 402, KLEANNE is calculated from a one-dimensional map stored in the ROM 107 by using the parameter $N_e$ as shown in the block of step 402. Then at step 403, $$KLEAN \leftarrow KLEANPM \cdot KLEANNE.$$

Thus, the finally obtained lean air-fuel ratio correction coefficient KLEAN is stored in the RAM 108 at step 404. The routine of FIG. 4 is completed by step 405.

Figure 5A:
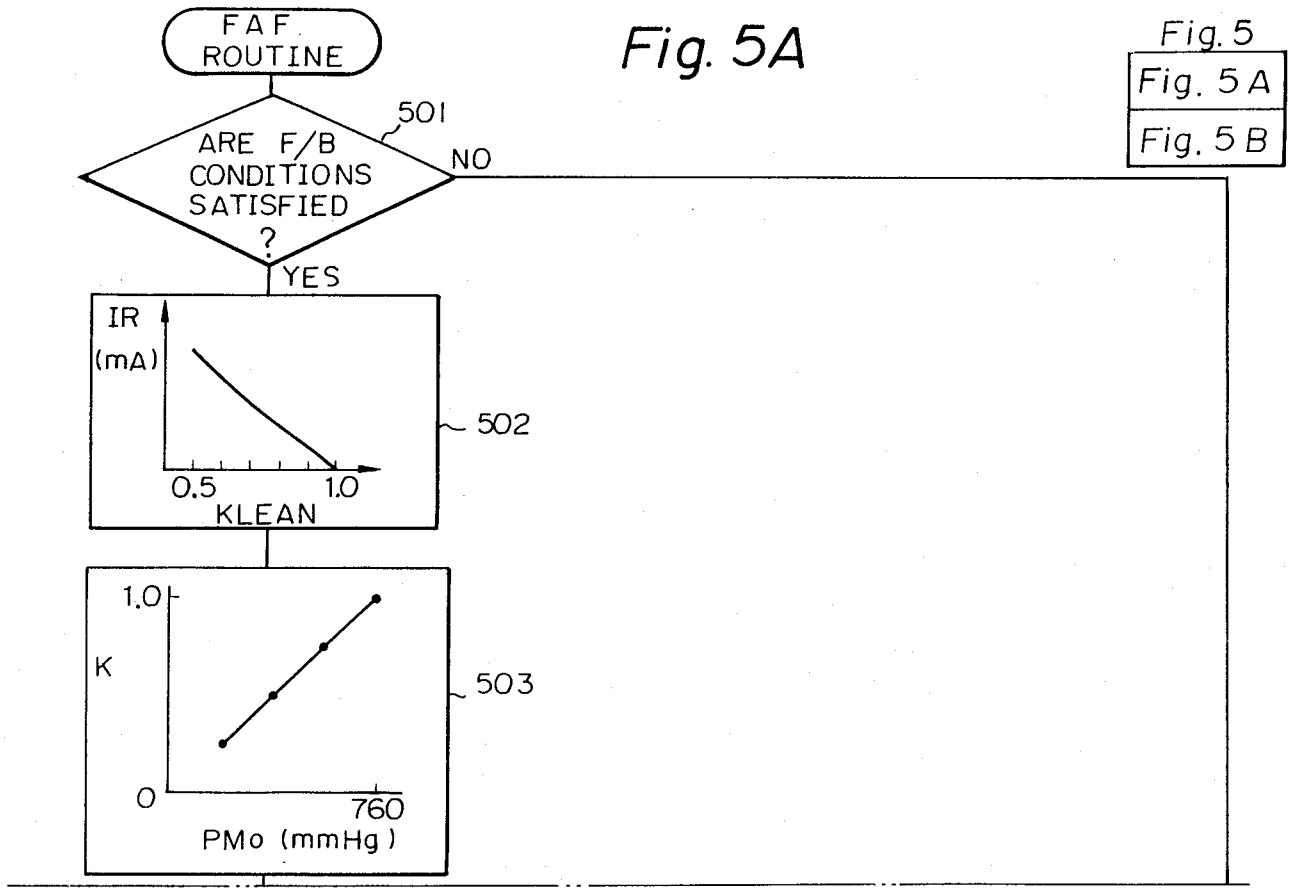
Figure 5B:
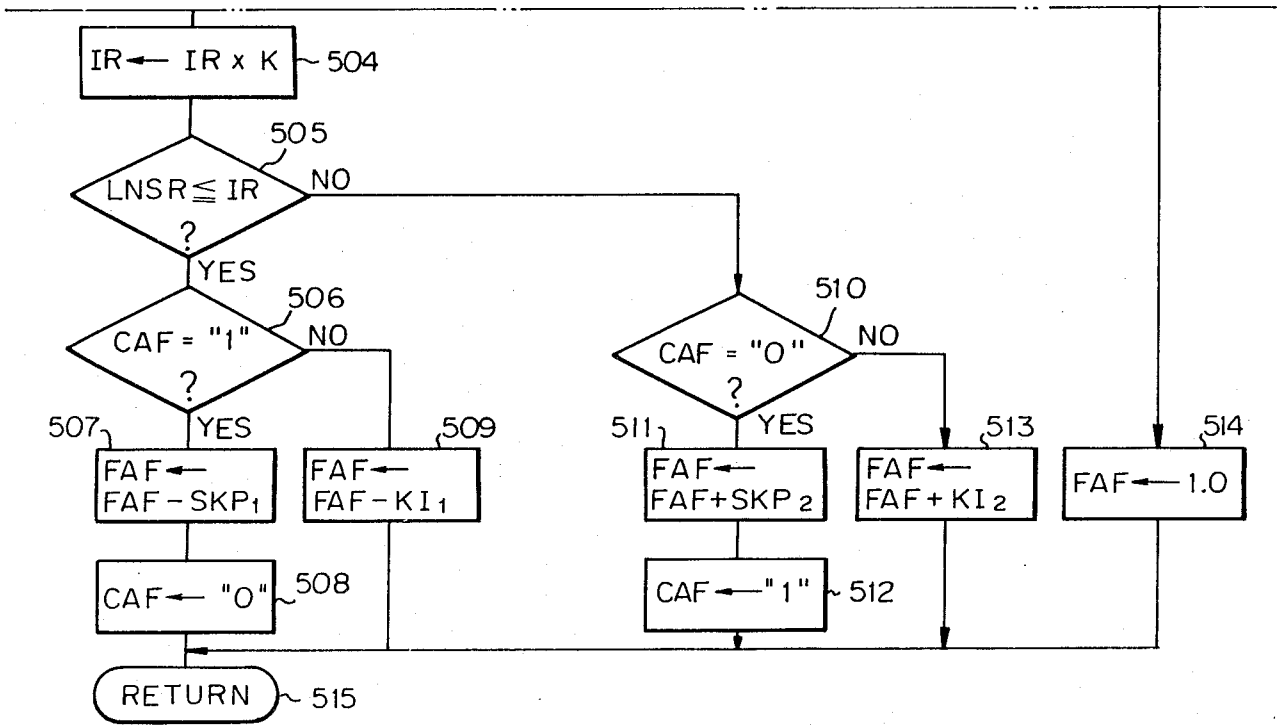

FIG. 5 is a routine for calculating an air-fuel ratio feedback correction coefficient FAF executed at every predetermined time period.

At step 501, it is determined whether or not all the feedback control (closed-loop control) conditions are satisfied. The feedback control conditions are as follows:

(i) the engine is not in a starting state;

(ii) the coolant temperature THW is higher than a definite value; and (iii) the power fuel increment FPOWER is 0.

Of course, other feedback control conditions are introduced as occasion demands. However, an explanation of such other feedback control conditions is omitted.

If one or more of the feedback control conditions is not satisfied, the control proceeds to step 514, in which the coefficient FAF is caused to be 1.0 (FAF=1.0), thereby carrying out an open-loop control operation. Contrary to this, if all the feedback control conditions are satisfied, the control proceeds to step 502.

At step 502, a comparison reference value IR is calculated from a one-dimensional map stored in the ROM 107 by using the parameter KLEAN obtained by the routine of FIG. 4. Note that this one-dimensional map is shown in the block of step 502. That is, the comparison reference value IR is variable in accordance with the coefficient KLEAN, thereby changing the aimed air-fuel ratio of the feedback control in accordance with the coefficient KLEAN.

At step 503, a correction amount K is calculated from a one-dimensional map stored in the ROM 107 by using the parameter $PM_0$ obtained by the routine of FIG. 3. Note that this one-dimensional map is shown in the block of step 503. That is, the correction amount K is used for correcting the comparison reference value IR. Accordingly, K=1 in the case of a low altitude (760 mmHg).

At step 504, the comparison reference value IR is corrected by the correction amount K. That is, $$IR \leftarrow IR \times K.$$

At step 505, the output LNSR of the lean mixture sensor 7 stored in the RAM 108 is compared with the comparison reference value IR, thereby determining whether the current air-fuel ratio is on the rich side or on the lean side with respect to the aimed air-fuel ratio. If LNSR≦IR, so that the current air-fuel ratio is on the rich side, the control proceeds to step 506, which determines whether or not a skip flag CAF is "1".

Note that the value "1" of the skip flag CAF is used for a skip operation when a first change from the rich side to the lean side occurs in the controlled air-fuel ratio, while the value "0" is used for a skip operation when a first change from the lean side to the rich side occurs in the controlled air-fuel ratio.

As a result, if the skip flag CAF is "1", the control proceeds to step 507, which decreases the coefficient FAF by a relatively large amount $SKP_1$. Then, at step 508, the skip flag CAF is cleared, i.e., CAF←"0". Thus, when the control at step 506 is further carried out, the control proceeds to step 509, which decreases the coefficient FAF by a relatively small amount $K_1$. Here, $SKP_1$ is a constant for a skip operation which remarkably increses the coefficient FAF when a first change from the lean side (LNSR>IR) to the rich side (LNSR≦IR) occurs in the controlled air-fuel ratio, while $KI_1$ is a constant for an integration operation which gradually decreases the coefficient FAF when the controlled air-fuel ratio is on the rich side.

On the other hand, at step 505, if LNSR>IR so that the current air-fuel ratio is on the lean side, the control proceeds to step 510, which determines whether or not the skip flag CAF is "0". As a result, if the skip flag CAF is "0", the control proceeds to step 511, which increases the coefficient FAF by a relatively large amount $SKP_2$. Then, at step 512, the skip flag CAF is set, i.e., CAF←"1". Thus, when the control at step 510 is further carried out, the control proceeds to step 513, which increases the coefficient FAF by a relatively small amount $KI_2$. Here, $SKP_2$ is a constant for a skip operation which remarkably increases the coefficient FAF when a first change from the rich side (LNSR≦IR) to the lean side (LNSR>IR) occurs in the controlled air-fuel ratio, while $KI_2$ is a constant for an integration operation which gradually increases the coefficient FAF when the controlled air-fuel ratio is on the lean side.

The air-fuel ratio feedback correction coefficient FAF obtained at step 507, 509, 511, 513, or 514 is stored in the RAM 108, and the routine of FIG. 5 is completed by step 515.

Figure 6:
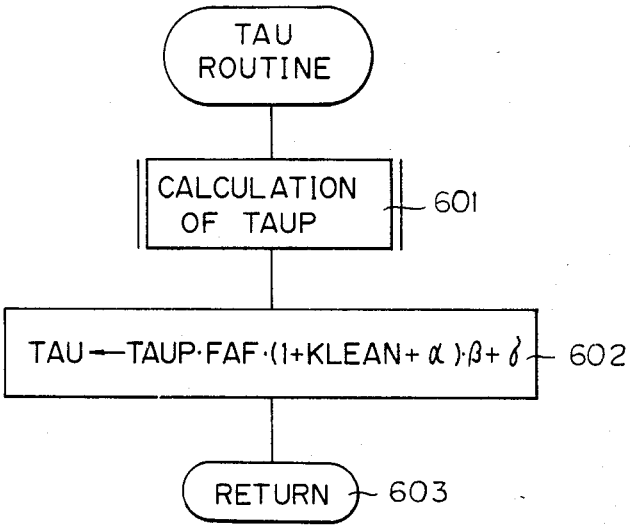

FIG. 6 is a routine for calculating a fuel injection time period TAU executed at every predetermined crank angle. For example, this routine is executed at every 360°CA in a simultaneous fuel injection system for simultaneously injecting all the injectors and is executed at every 180°CA in a sequential fuel injection system applied to a four-cylinder engine for sequentially injecting the injectors thereof.

At step 601, a base fuel injection time period TAUP is calculated from a two-dimensional map stored in the ROM 107 by using the parameters PM and $N_e$. Then, at step 602, a fuel injection time period TAU is calculated by $$TAU \leftarrow TAUP \cdot FAF \cdot (1 + KLEAN + \alpha) \cdot \beta + \gamma$$

where $\alpha$, $\beta$, and $\gamma$ are correction factors determined by other parameters such as the signal of the intake air temperature sensor, the voltage of the battery (both not shown), and the like. Then the calculated fuel injection time period TAU is stored in the RAM 108, and the routine of FIG. 6 is completed by step 603.

Figure 7:
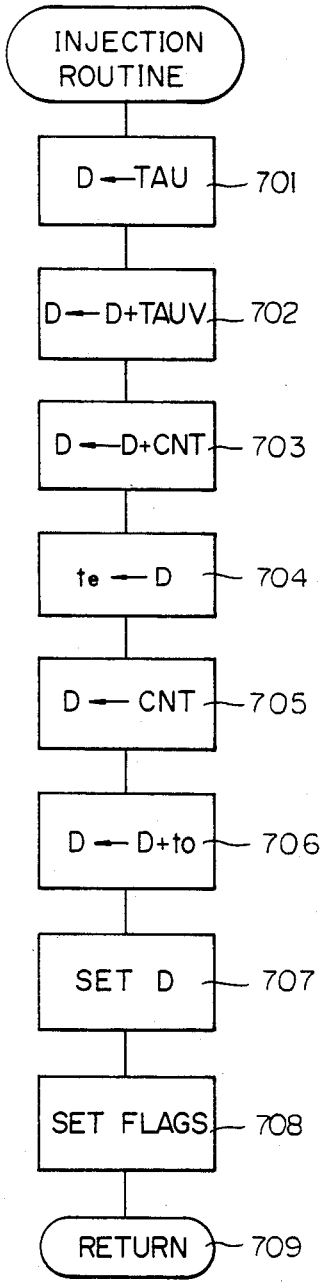

FIG. 7 is a routine for controlling the fuel injection in accordance with the fuel injection time period TAU calculated by the routine of FIG. 6, executed at every predetermined crank angle. Also, this routine is executed at every 360°CA in a simultaneous fuel injection system and is executed at every 180°CA in an sequential fuel injection system applied to a four-cylinder engine.

At step 701, the fuel injection time period TAU stored in the RAM 108 is read out and is transmitted to the D register (not shown) included in the CPU 105. At step 702, an invalid fuel injection time period TAUV which is also stored in the RAM 108 is added to the content of the D register. In addition, at step 703, the current time CNT of the free-run counter of the timer counter 106 is read out and is added to the content of the D register, thereby obtaining an injection end time $t_e$ in the D register. Therefore, at step 704, the content of the D register is stored as the injection end time $t_e$ in the RAM 108.

Again at step 705, the current time CNT of the free-run counter is read out and is set in the D register. Then, at step 706, a small time period $t_0$, which is definite or determined by the predetermined parameters, is added on the content of the D register. At step 707, the content of the D register is set in the compare register of the timer counter 106, and at step 708, a fuel injection execution flag and a compare I interrupt permission flag are set in the registers of the timer counter 106. The routine of FIG. 7 is completed by step 709.

Figure 8:
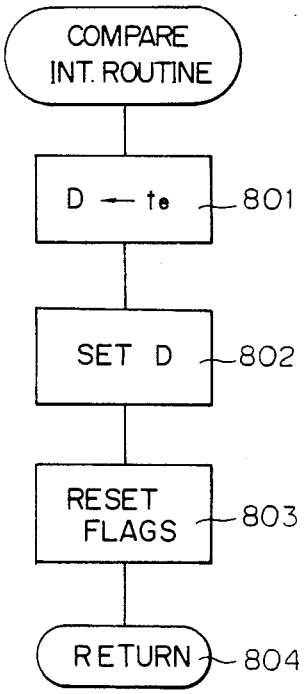

Thus, when the current time CNT of the free-run counter reaches the compare register, an injection-on signal due to the presence of the fuel injection execution flag is transmitted from the timer counter 106 via the I/O interface 103 to the driver circuit 104, thereby initiating fuel injection by the fuel injector 7. Simultaneously, a compare interrupt signal due to the presence of the compare interrupt permission flag is transmitted from the timer counter 106 to the CPU 105, thereby initiating a compare interrupt routine as illustrated in FIG. 8.

The completion of the fuel injection will be explained with reference to FIG. 8. At step 801, the injection end time $t_e$ stored in the RAM 108 is read out and is transmitted to the D register. At step 802, the content of the D register is set in the compare register of the timer counter 106 and at step 803, the fuel injection execution flag and the compare interrupt permission flag are reset. The routine of FIG. 8 is completed by step 804.

Thus, when the current time CNT of the free-run counter reaches the compare register, an injection-off signal due to the absence of the fuel injection execution flag is transmitted from the timer counter 106 via the I/O interface 103 to the drive circuit 104, thereby ending the fuel injection by the fuel injector 5. In this case, however, no compare interrupt signal is generated due to the absence of the compare interrupt permission flag.

Thus, fuel injection of the fuel injector 5 is carried out for the time period TAU.

Figure 9:
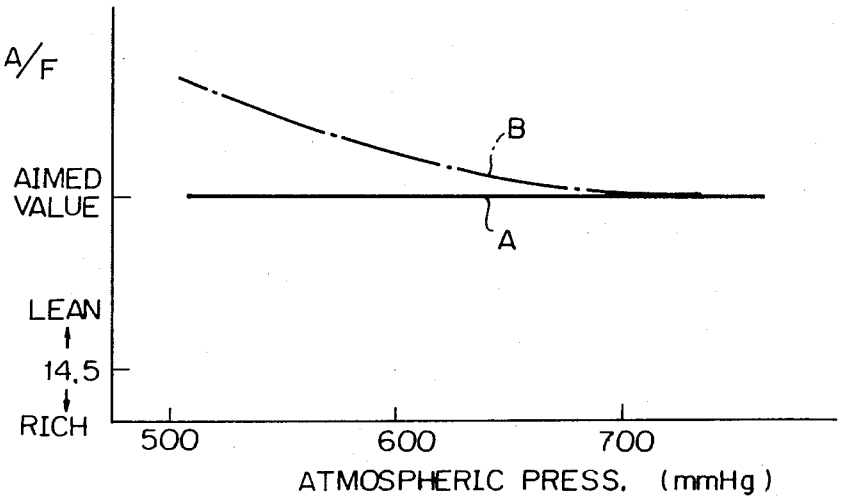
FIG. 9 is a graph showing the effect according to the present invention.

FIG. 9 is a graph showing the effect according to the present invention. That is, according to the present invention, the controlled air-fuel ratio is consistent with the aimed air-fuel ratio irrespective of the actual atmospheric pressure as indicated by A. However, in the prior art, as the actual atmospheric pressure is reduced, the controlled air-fuel ratio is shifted from the aimed air-fuel ratio, which may incur misfiring or surging.

We claim:

1. A method for controlling the air-fuel ratio in an internal combustion engine having a throttle valve within an intake air passage thereof, and lean mixture sensor means for generating a signal in accordance with a concentration of a specific composition in the exhaust gas, said signal changing in value as an atmospheric pressure around said lean mixture sensor is changed, comprising the steps of:

calculating a reference signal value in accordance with predetermined parameters of said engine;

detecting an atmospheric pressure;

correcting the calculated reference signal value in accordance with the detected atmospheric pressure; and controlling the feedback of the air-fuel ratio so that said signal is brought close to the corrected reference signal value.

2. An apparatus for controlling the air-fuel ratio in an internal combustion engine, comprising:

a throttle valve within an intake air passage thereof;

lean mixture sensor means for generating a signal in accordance with a concentration of a specific composition in the exhaust gas, said signal changing in value as an atmospheric pressure around said lean mixture sensor means is changed;

means for calculating a reference signal value in accordance with predetermined parameters of said engine;

means for detecting the atmospheric pressure;

means for correcting the calculated reference signal value in accordance with the detected atmospheric pressure; and means for controlling the feedback of the air-fuel ratio so that said signal is brought close to the corrected reference current value.

3. A method for controlling the air-fuel ratio in an internal combustion engine having a throttle valve within an intake air passage thereof, comprising the steps of:

generating a signal which is proportional to a concentration of a specific composition in an exhaust gas;

calculating a reference signal value in accordance with predetermined parameters of said engine;

detecting an atmospheric pressure;

correcting the calculated reference signal value in accordance with the detected atmospheric pressure; and controlling a feedback of the air-fuel ratio of said engine so that said signal is brought close to the corrected reference signal value.

4. A method as set forth in claim 3, wherein said reference signal value correcting step decreases said reference signal value when the detected atmospheric pressure becomes low.

5. A method as in claim 3, wherein said reference signal is determined in accordance with an aimed air-fuel ratio.

6. A method as set forth in claim 3, wherein said atmospheric pressure detecting step comprises the steps of:

detecting an intake air pressure of said engine;

detecting an engine speed;

correcting the detected intake air pressure in accordance with the detected engine speed;

determining whether an opening of said throttle valve is larger than a predetermined value;

determining whether the atmospheric pressure is larger than the corrected intake air pressure;

replacing the atmospheric pressure with the corrected intake air pressure, when one of: (a) the opening of said throttle valve is larger than the predetermined value and the atmospheric pressure is larger than the corrected intake air pressure and (b) when the opening of said throttle valve is not larger than the predetermined value and the atmospheric pressure is not larger than the corrected intake air pressure.

7. A method as set forth in claim 6, wherein said intake air pressure correcting step comprises the steps of:

calculating a correction amount in accordance with the detected engine speed; and adding said correction amount to the detected intake air pressure.

8. A method as set forth in claim 7, wherein said correction amount is small when the engine speed is low, while said correction amount is large when the engine speed is high.

9. A method as set forth in claim 3, wherein said atmospheric pressure detecting step comprises the steps of:

detecting an intake air amount of said engine;

detecting an engine speed;

calculating an intake air amount per one engine revolution;

correcting the calculated intake air amount per one engine revolution in accordance with the detected engine speed;

determining whether an opening of said throttle valve is larger than a predetermined value;

determining whether the atmospheric pressure is larger than a pressure value corresponding to the corrected intake air amount per one engine revolution;

replacing the atmospheric pressure with the pressure value corresponding to the corrected intake air amount per one engine revolution when one of: (a) the opening of said throttle valve is larger than the predetermined value and the atmospheric pressure is larger than the pressure value corresponding to the corrected intake air amount per one engine revolution, and (b) when the opening of said throtte valve is not larger than the predetermined value and the atmospheric pressure is not larger than the pressure value corresponding to the corrected intake air amount per one engine revolution.

10. A method as set forth in claim 9, wherein said intake air amount per one engine revolution correcting step comprises the steps of:

calculating a correction amount in accordance with the detected engine speed; and adding said correction amount to the calculated intake air amount per one engine revolution.

11. A method as set forth in claim 10, wherein said correction amount is small when the engine speed is low, while said correction amount is large when the engine speed is high.

12. An apparatus for controlling the air-fuel ratio in an internal combustion engine having a throttle valve within an intake air passage thereof, comprising:

means for generating a signal proportional to a concentration of a specific composition in the exhaust gas;

means for calculating a reference signal in accordance with predetermined parameters of said engine;

means for detecting an atmospheric pressure;

means for correcting the calculated reference signal in accordance with the detected atmospheric pressure; and means for controlling a feedback of the air-fuel ratio of said engine so that said signal is brought close to the corrected reference signal.

13. An apparatus as set forth in claim 12, wherein said aimed air-fuel ratio correcting means comprises:

means for decreasing the reference signal when the detected atmospheric pressure is low; and means for increasing the reference signal when the detected atmospheric pressure is high.

14. An apparatus as in claim 12 wherein said reference signal is determined in accordance with an aimed air-fuel ratio.

15. Apparatus as in claim 12 wherein said signal is a current.

16. An apparatus as set forth in claim 12, wherein said atmospheric pressure detecting means comprises:

means for detecting an intake air pressure of said engine;

means for detecting an engine speed;

means for correcting the detected intake air pressure in accordance with the detected engine speed;

means for determining whether an opening of said throttle valve is larger than a predetermined value;

means for determining whether the atmospheric pressure is larger than the corrected intake air pressure;

means for replacing the atmospheric pressure with the corrected intake air pressure when one of: (a) the opening of said throttle valve is larger than the predetermined value and the atmospheric pressure is larger than the corrected intake air pressure, and (b) when the opening of said throttle valve is not larger than the predetermined value and the atmospheric pressure is not larger than the corrected intake air pressure.

17. An apparatus as set forth in claim 16, wherein said intake air pressure correcting means comprises:

means for calculating a correction amount in accordance with the detected engine speed and means for adding said correction amount to the detected intake air pressure.

18. An apparatus as set forth in claim 17, wherein said correction amount is small when the engine speed is low, while said correction amount is large when the engine speed is high.

19. An apparatus as set forth in claim 12, wherein said atmospheric pressure detecting means comprises:

means for detecting an intake air amount of said engine;

means for detecting an engine speed;

means for calculating an intake air amount per one engine revolution;

means for correcting the calculated intake air amount per one engine revolution in accordance with the detected engine speed;

means for determining whether an opening of said throttle valve is larger than a predetermined value;

means for determining whether the atmospheric pressure is larger than a pressure value corresponding to the corrected intake air amount per one engine revolution;

means for replacing the atmospheric pressure with the pressure value corresponding to the corrected intake air amount per one engine revolution, when one of: (a) the opening of said throttle valve is larger than the predetermined value and the atmospheric pressure is larger than the pressure value corresponding to the corrected intake air amount per one engine revolution, and (b) when the opening of said throttle valve is not larger than the predetermined value and the atmospheric pressure is not larger than the pressure value corresponding to the corrected intake air amount per one engine revolution.

20. An apparatus as set forth in claim 19, wherein said intake air amount per one engine revolution correcting means comprises:

means for calculating a correction amount in accordance with the detected engine speed; and means for adding said correction amount to the calculated intake air amount per one engine revolution.

21. An apparatus as set forth in claim 20, wherein said correction amount is small when the engine speed is low, while said correction amount is large when the engine speed is high.

* * * * *